United States Patent [19]

Fox et al.

[11] 4,454,856

[45] Jun. 19, 1984

[54] DISTRIBUTOR CONSTRUCTION AND SIGNAL GENERATOR

[75] Inventors: David H. Fox, Ann Arbor; Charles C. Kostan, Canton Township, Plymouth County; Frank B. Casaceli, Mt. Clemens, all of Mich.

[73] Assignee: Ford Motor Company, Dearborn, Mich.

[21] Appl. No.: 432,892

[22] PCT Filed: Aug. 27, 1982

[86] PCT No.: PCT/US82/01167

§ 371 Date: Aug. 27, 1982

§ 102(e) Date: Aug. 27, 1982

[51] Int. Cl.[3] ..... F02P 7/00

[52] U.S. Cl. ..... 123/617; 123/146.5 A

[58] Field of Search ..... 123/617, 612, 146.5 A, 123/414, 476; 310/70 R, 70 A; 324/208; 200/19 M

[56] References Cited

U.S. PATENT DOCUMENTS

| | | | |
|---|---|---|---|
| 3,308,341 | 3/1968 | McLaughlin | 123/617 |
| 3,577,970 | 5/1971 | King et al. | 123/146.5 A |
| 4,003,359 | 1/1977 | Hays | 123/146.5 A |
| 4,150,653 | 4/1979 | Grancoin | 123/617 |
| 4,155,340 | 5/1979 | Fernquist et al. | 123/617 |
| 4,165,726 | 8/1979 | Helmer, Jr. | 123/146.5 A |
| 4,359,978 | 11/1982 | Brammer et al. | 123/617 |
| 4,403,579 | 9/1983 | Young et al. | 123/146.5 A |

*Primary Examiner*—Andrew M. Dolinar

*Attorney, Agent, or Firm*—Peter Abolins; Robert D. Sanborn

[57] ABSTRACT

A distributor (10) includes a magnetic ring (14) mounted on an intermediate shaft which is directly coupled to a camshaft (20). A sensor (54) has a known position with respect to the poles on the magnetic ring (14) and is mounted to a stationary portion of the engine (22).

7 Claims, 7 Drawing Figures

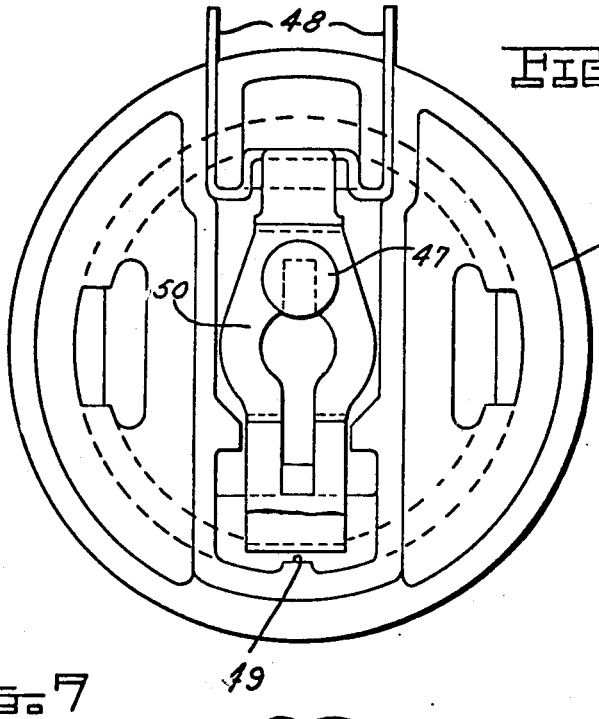
FIG. 6
FIG. 7
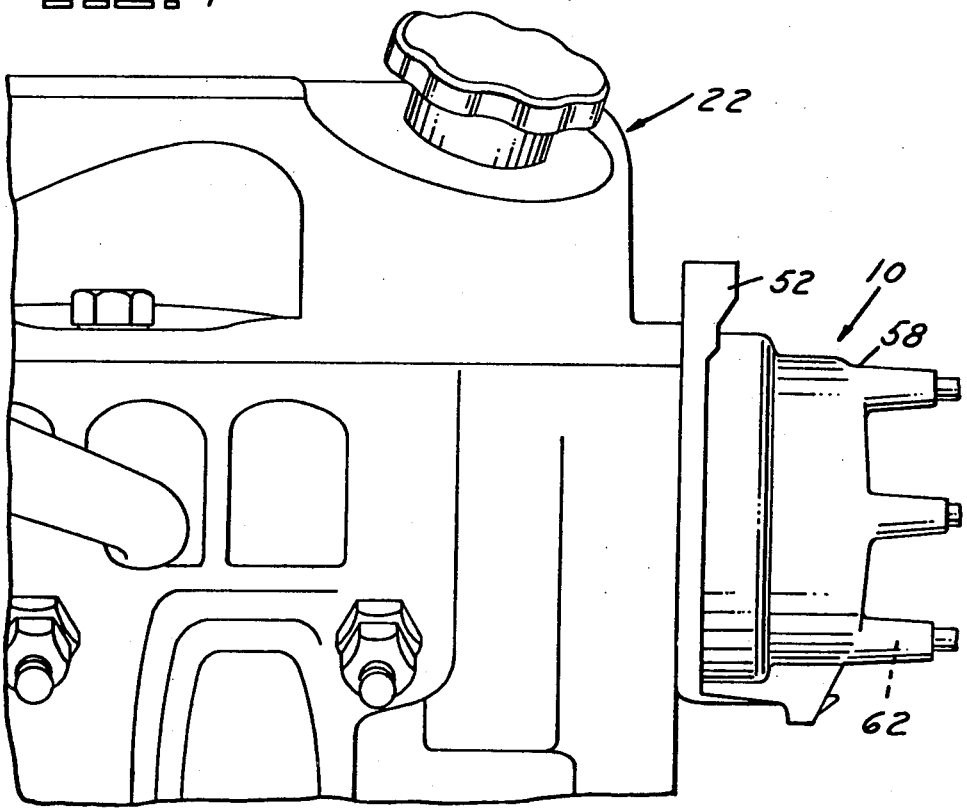

DISTRIBUTOR CONSTRUCTION AND SIGNAL GENERATOR

This application relates to commonly assigned copending application 82-6-I entitled "Method of on Site Charging of Distributor Magnet," invented by F. B. Casaceli; D. H. Fox and C. C. Kostan.

TECHNICAL FIELD

This invention relates to a distributor construction including a signal generator for use in an internal combustion engine.

BACKGROUND ART

In machines having a cyclic operation, as in internal combustion engines, certain operations or movements must be controlled or actuated in synchronism with the displacement or rotation of a part such as the camshaft. For example, the occurrence of spark ignition, fuel injection and movement of a valve must be coordinated. To achieve the desired sequential coordination, a signal generator indicates the position of the camshaft.

Known distributors have signal generating apparatus including a fixed magnet with turning vanes which change the intensity of the magnetic field adjacent the magnet. An inductive sensor adjacent the magnet can sense these field fluctuations.

U.S. Pat. No. 4,235,213 to Jellissen teaches an ignition system having a Hall effect sensor with a magnetic circuit positioned to provide magnetic flux through the Hall effect sensor. The magnetic flux through the Hall effect sensor is interruptable by a high permeability vane moving through the air gap in the magnetic circuit, activating the Hall effect sensor to provide timing signals for an automotive ignition distributor system. A housing in an automotive ignition distributor system is mounted on a swing arm pivotal about the axis of a distributor shaft. The housing contains a magnetic circuit and a circuit board having a Hall effect sensor affixed thereto.

Analogously, U.S. Pat. No. 4,150,653 issued to Grancoin teaches a magnetic field source produced by a rotating shaft and a Hall effect sensor positioned within the field.

U.S. Pat. No. 4,223,249 issued to Eschelman teaches a bistable magnetic wire having an electrically conductive wire coil thereabout to form a magnetic wire assembly adjacent the magnet. The ends of the conductive wire are electrically connected to a sensing apparatus. A shield or shutter arrangement operated between the magnetic wire assembly and the magnet serves to cause the magnetic wire to be at times placed under the influence of the magnetic field of the magnet thereby resulting in the magnetic wire changing from one stable state to another state. In so changing states, a voltage is induced into the inductive wire to produce a pulse across the ends of the wire.

Various problems with the known prior art include signal sensitivity not only to position of the rotating element but also to the speed of rotation. Further, the magnitude of the signal indicating a particular position may not be sufficiently different from the magnitude of a signal indicating another position. Such a lack of distinction in magnitudes may be particularly undesirable in environments having high noise such as an automotive engine.

U.S. Pat. No. 4,165,726 issued to Helmer teaches a distributor 10 which is coupled to an engine 28. Extending downwardly from the housing for the distributor is an integrally formed tubular shank or end portion 20 with a stepped mounting flange 22 at its lower end, which is received in an opening and is suitably secured to the engine block. Stem portion 20 includes an upper thrust bearing 23 and a lower sleeve bearing 24 in which is journaled the distributor rotor shaft 26, which is formed of machined steel and is suitably coupled to and rotatably driven from the electrically grounded engine.

Also known are various geared couplings between the engine crankshaft and the shaft of the distributor. Typically, a pinion gear is used to transmit crankshaft rotation to the distributor shaft causing it to rotate.

Such an elaborate connection between a crankshaft and the rotating portion of the distributor providing a signal indicative of crankshaft position is both expensive and prone to various inaccuracies. That is, any looseness in the coupling between the crankshaft and the signal generating device would cause an erroneous indication of crankshaft position. Further, an accurate transmission of crankshaft movement requires relatively close manufacturing tolerances which are typically expensive. A simpler, more direct coupling between the crankshaft and the distributor would be desirable. These are some of the problems this invention overcomes.

In distributor mountings, it is also known to attach a spring to a rotor by the use of an ultrasonically deformed rivet. It would be desirable to eliminate the use of such a rivet to reduce the number of pieces required for assembly and the expensive tooling required to ultrasonically insert the rivet. The elimination of this process would reduce the number of possible ignition system failure areas along with reducing the overall cost of the rotor.

DISCLOSURE OF INVENTION

A multiple pole magnet adapted to be charged in place has a generally ring-like configuration and is mounted on the distributor. The magnet is formed of a plastic material to reduce rotating weight and cost. A bipolar Hall sensor positioned adjacent the rotating magnetic ring provides a signal indicative of crankshaft position information. The bipolar feature results in a sensor that switches on and off by being subjected to a positive magnetic flux (associated with a north magnetic pole) and a negative magnetic flux (associated with a south magnetic pole) after experiencing a zero flux condition at the positive and negative transition. Such a signal can be utilized in an electronic engine control.

In accordance with a further embodiment of this invention, the distributor includes an intermediate shaft mounted and oriented directly on the engine camshaft thereby eliminating the need for bearings. The rotating portion of the distributor is mounted to and supported by the camshaft. The stationary part of the distributor is mounted to and supported by the engine block. There is no portion of the stationary part of the distributor which supports a rotating portion of the distributor.

In a still further embodiment of this invention, a spring is attached to the rotor body by a positive locking feature to the electrode, thus insuring a positive, electrically conductive path between the two pieces.

BRIEF DESCRIPTION OF THE DRAWINGS

FIG. 6 is a top view of the rotor of a distributor in accordance with an embodiment of this invention; and FIG. 7 is a side view of an engine and a distributor mounted thereon in accordance with an embodiment of this invention.

BEST MODE FOR CARRYING OUT THE INVENTION

Figure 1:
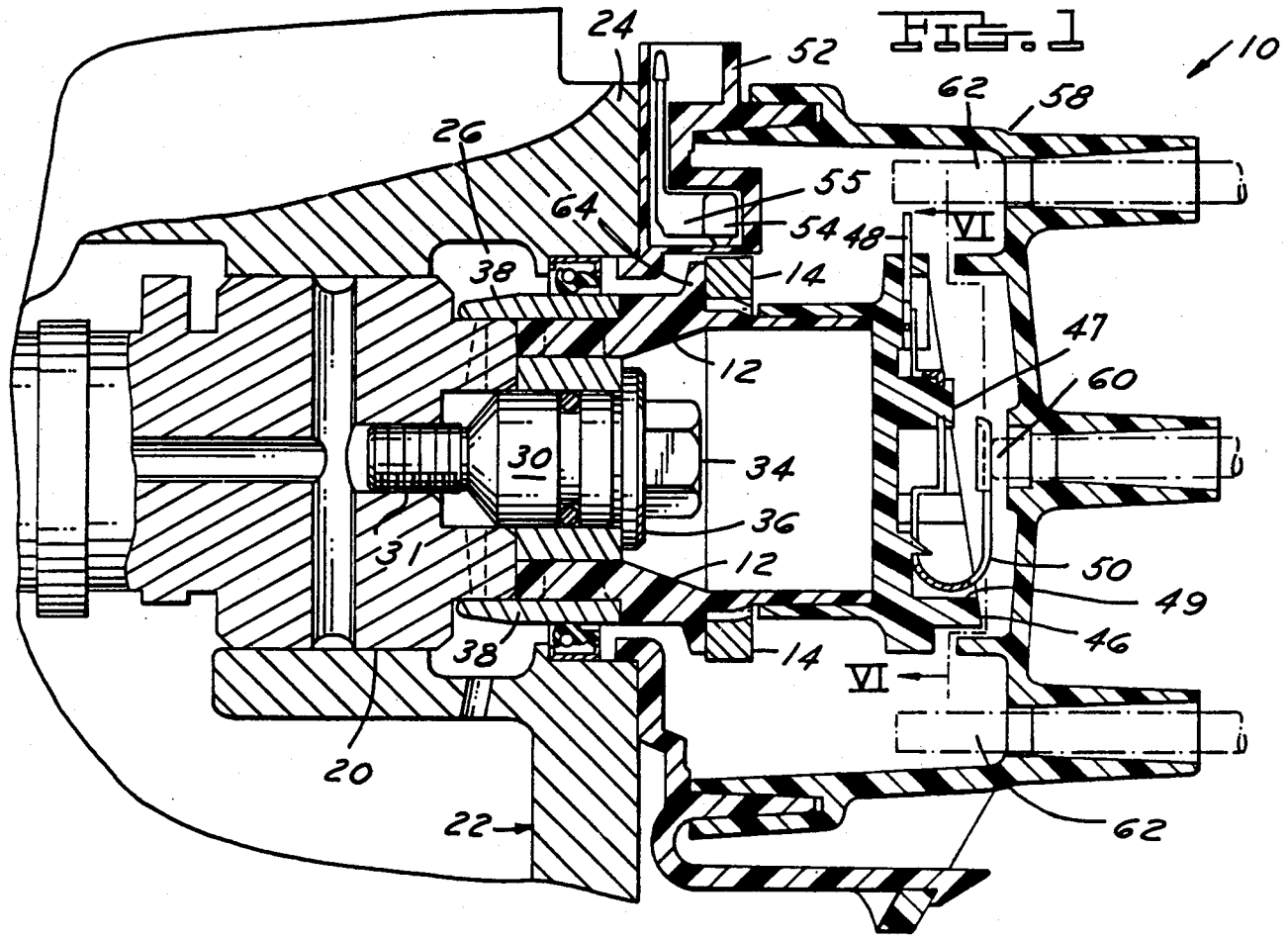
FIG. 1 is a cross-section of a distributor mounted on an engine camshaft in accordance with an embodiment of this invention.
Figure 5:
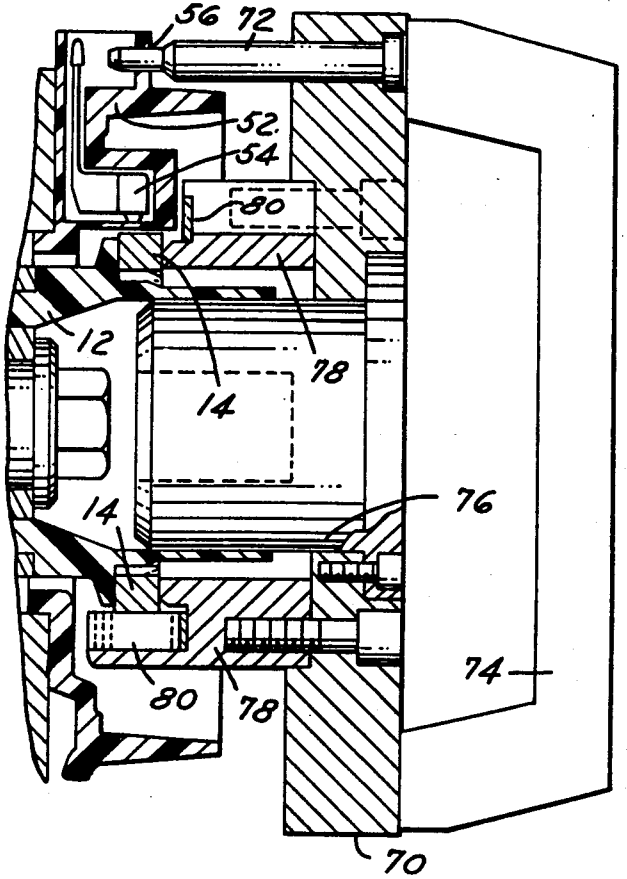
FIG. 5 is a section view taken generally along section line 5—5 of FIG. 4 and includes a portion of the distributor of FIG. 1 to show how the magnetic charging tool mates with the distributor.

Referring to FIGS. 1 and 7, distributor 10 is directly mounted on a camshaft 20 of an engine 22. An intermediate shaft 12 is mounted and oriented directly on camshaft 20 eliminating the need for any bearings. A ring-like magnet 14 is positioned on intermediate shaft 12 to provide an indication of the rotational position of intermediate shaft 12, of camshaft 20 and therefore of the engine crankshaft. Magnetic poles are induced in magnet 14 after magnet 14 is positioned on intermediate shaft 12. Such in place charging of magnet 14 (FIG. 5) permits accurate correlation between the rotational position of the magnetic poles on magnet 14 and the rotational position of the crankshaft in engine 22. As a result, it is possible to compensate for manufacturing tolerances which may otherwise contribute to inaccuracies.

Intermediate shaft 12 is a generally hollow cylinder with decreasing diameter toward the end mounted on the outer diameter of camshaft 20. A screw 34 in combination with a washer 36 is attached to a mounting stud 30 and engages an insert 38 coupled to intermediate shaft 12 thereby securing intermediate shaft 12 to mounting stud 30. Mounting stud 30 has a threaded portion 31 which screws into the central opening of camshaft 20. Intermediate shaft 12 has a plurality of radial, circumferentially spaced openings at the end adjacent camshaft 20. Insert 38 is a web that extends through the radial openings in intermediate shaft 12 and has integral circumferential ring-like portions both inside and outside intermediate shaft 12. intermediate shaft 12 is formed of a combination of powdered metal and plastic. Similarly, insert 38 is also formed of a plastic and powdered metal combination and formed in place by injection around intermediate shaft 12.

Figure 2:
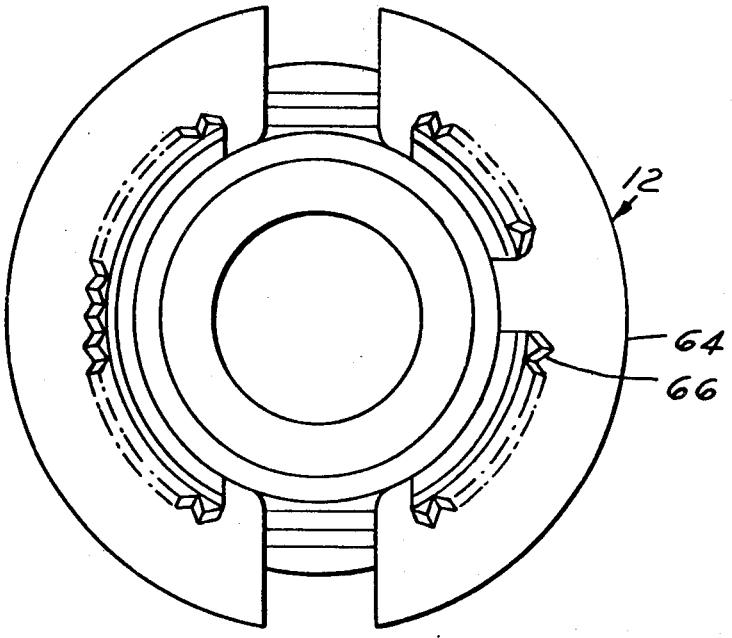
FIG. 2 is an end view of an intermediate shaft which is coupled to the engine camshaft.
Figure 3:
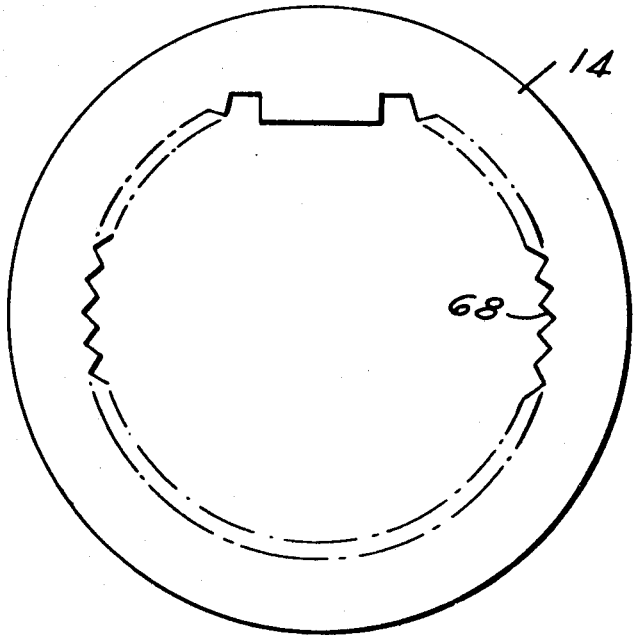
FIG. 3 is an end view of a magnet to be mounted on the intermediate shaft in accordance with an embodiment of this invention.

A lip seal 42 between insert 38 and engine head 24 acts as a seal to keep oil in passages 26 around camshaft 20 from leaking from engine 22. A shoulder portion 64 of intermediate shaft 12 supports magnet 14 as shown in FIG. 2. Shoulder portion 64 has circumferential, outwardly facing teeth 66. Magnet 14 (FIG. 3) has circumferential, inwardly facing teeth 68 for engaging teeth 66.

The end of intermediate shaft 12 projecting away from engine 22 supports a rotor 46 (see FIG. 6). Rotor 46 carries a staple-like electrode 48 and spring 50. The mounting of spring 50 on rotor 46 is accomplished by a compression fit and uses no secondary mounting process such as a rivet or a heat stake. Rotor 46 includes a clamp-like ledge 47 to hold down spring 50. A back stop 49 acts in cooperation with ledge 47 to positively hold spring 50 to rotor 46. Such a construction for attaching spring 50 provides a positive locking feature to electrode 48 thus insuring a positive, electrically conductive path between the two pieces. Staple-like electrode 48 reduces cost of manufacturing. The wire drawn material minimizes material costs and weight. The staple form can be obtained by relatively low cost tooling. The sharp pointed electrode design also reduces the generation of high levels of radio frequency interference.

Sensor 54 (FIGS. 1 and 5) is coupled to an electronic engine control and provides crankshaft position information. Sensor 54 is a bipolar Hall-type device. The bipolar feature results in a sensor that switches on and off by being subjected to a positive magnetic flux and a negative magnetic flux after experiencing a zero flux condition at transitions between positive and negative magnetic flux. A positive magnetic flux is associated with the passage of a north magnetic pole on magnet 14 and a negative magnetic flux is associated with the passage of a south magnetic pole on magnet 14.

A sensor holder 52 (FIGS. 1, 5 and 7) is mounted on head 24 and supports bipolar Hall-type sensor 54 in proximity to magnet 14. Sensor holder 52 includes charging tool locating holes 56 for receiving pins 72 positioning a charging tool 70 to charge magnet 14 (see FIG. 5). Accordingly, after magnet 14 is positioned on intermediate shaft 12, sensor holder 52 is mounted on head 24, and the engine position is determined to be in a known position (such as top dead center of cylinder one). Sensor holder 52 also supports distributor cap 58 in proximity to spring 50 and electrode 48 so that a firing voltage can be supplied through a central electrode 60 to spring 50 and distributed through electrode 48 to a plurality of spark plug associated electrodes 62 (FIG. 1).

Figure 4:
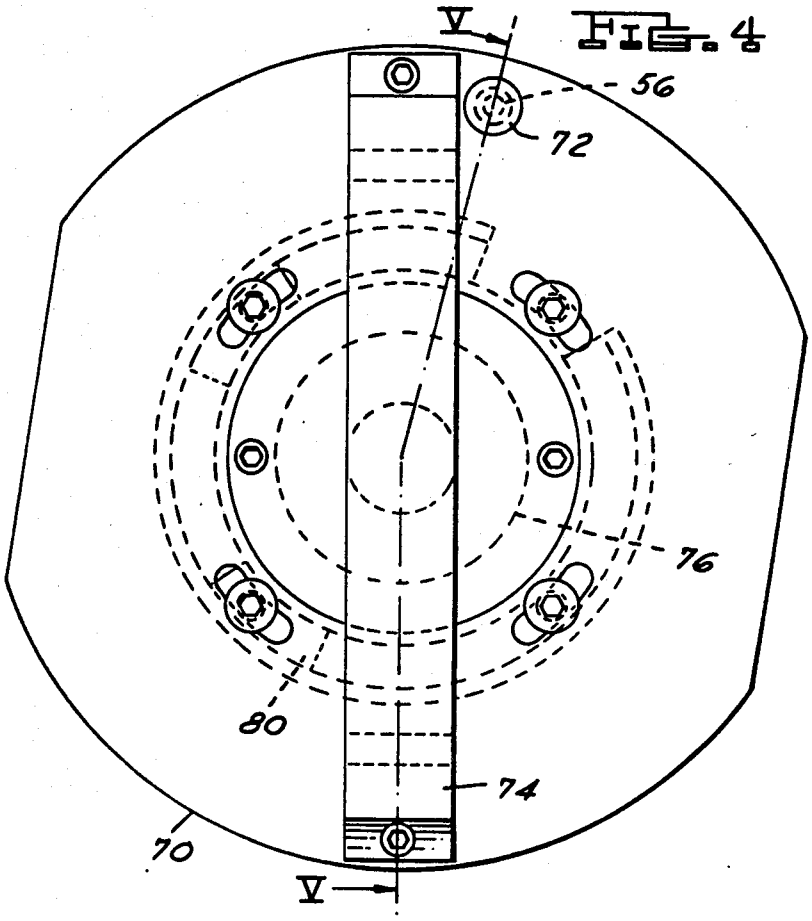
FIG. 4 is an elevation view of a magnetic charging tool for a distributor in accordance with an embodiment of this invention.

Charging tool 70 (FIGS. 4 and 5) is generally circular with a protruding handle 74. A circular pilot 76 extends along the axis of charging tool 70 for engaging the central opening of intermediate shaft 12. A pair of pins 72 extend parallel to pilot 76 for engaging locating holes 56. A partially hollow cylindrical portion 78 extends around pilot 76 along the outside of intermediate shaft 12 to magnet 14. An undulating conductor bus bar 80 is supported by cylindrical portion 78 adjacent magnet 14. The undulations are, in sequence, axially upward, circumferential, axially downward, circumferential, axially upward, and so on. The axial portions of bus bar 80 are spaced about 45° apart so that current flowing in bus bar 80 induces eight magnet poles in magnet 14. Magnet 14 is mounted on intermediate shaft 12 as an uncharged injection molded plastic magnet containing oriented magnetic dipoles. The engine crankshaft is positioned to a known position (relative to top dead center of cylinder number one) and a magnetizing fixture is located relative to sensor 54 and magnet 14. At this point, torque can be applied to camshaft 20 to take up any timing belt looseness and the magnet 14 is magnetized.

Ring-like magnet 14 is magnetized relative to a known engine position so that the 45° north and south poles are generated alternately over the outer diameter of the magnetic in a location such that the sensor switches at a prescribed point relative to the known engine position. Advantageously, bipolar Hall-type sensor 54 is potted in the plastic base which is mounted directly to the engine head to assure a positive known location in relation to the rotation of the magnet. For example, the crankshaft can be located at 35° after top dead center (ATDC) so that charging conductors can be equally spaced around sensor. This will result in a signal being generated at 10° before top dead center (BTDC) by the sensor during engine operation.

Sensor 54 is triggered by a low magnetic flux level, such as plus and minus 50 gauss around a zero flux transition point, and its sensitivity to air gap size, temperature and run-out variation is minimal. The maximum amplitude of magnetic flux at the pole face is approximately 900 gauss. Sensor holder 52 also contains a pole piece 55 (FIG. 1) adjacent sensor 54 to focus the magnetic flux from magnet 14 thereby concentrating the flux to improve the accuracy of sensor 54.

Various modifications and variations will no doubt occur to those skilled in the various arts to which this invention pertains. For example, the particular configuration of the sensor holder may be varied from that described herein. These and all other variations which basically rely on the teachings through which this disclosure has advanced the art are properly considered within the scope of this invention.

We claim:

1. A timing system in an internal combustion engine having a camshaft for producing an electric signal in synchronism with the periodic movement of an engine part, said signal being subjected to a variable phase shift and controlling a cyclic operation of said engine, comprising:

a permanently magnetized ring mounted on an intermediate shaft member directly coupled to the engine camshaft and oriented in a plane perpendicular to the axis of rotation, said ring having a plurality of alternating north and south magnetic poles;

a bipolar Hall-type crank position sensor means positioned adjacent said magnetized ring for detecting passage of magnetic poles on said mgnetized ring;

said magnetized ring having a plurality of adjacent north and south magnetic poles; and said bipolar Hall-type sensor responding with two polarities to the passage of north and south magnetic poles on said magnetized ring.

2. A timing system in an internal combustion engine for producing an electric signal in synchronism with the periodic movement of an engine part as recited in claim 1 wherein:

said sensor means is coupled to a fixed portion mounted directly on a stationary portion of the engine.

3. A timing system in an internal combustion engine for producing an electric signal in synchronism with the periodic movement of an engine part as recited in claim 2 further comprising:

a rotor carrying an electrode for passing spark voltage being coupled to said intermediate shaft member and thus coupled to the camshaft of the engine without an intermediate bearing.

4. A distributor for an internal combustion engine having a camshaft and an engine block for producing an electrical signal in synchronism with the periodic movement of the engine, said distributor comprising:

a ring of magnetic material means directly coupled to the camshaft of the internal combustion engine, said ring having a plurality of alternating north and south magnetic poles; said magnetic material means including an intermediate shaft means directly coupled to the camshaft;

means defining a sensor reference point directly coupled to the engine block, said means defining said reference point being stationary with respect to the engine block and including a sensor holder means directly coupled to the engine block, said holder means holding a bipolar Hall-type sensor adjacent and spaced from said magnetic material means;

a rotor directly coupled to said ring of magnetic material; and distributor cap means for supplying high voltage energy to spark plugs directly coupled to said means defining said sensor reference point.

5. A distributor as recited in claim 4 wherein:

said intermediate shaft means including a supporting ledge having adjacent circumferentially spaced teeth and a generally axial pilot opening; and said magnetic material means includes a magnetic generator including a ring-like magnetic material with generally inwardly facing circumferentially spaced teeth adjacent the supporting ledge so that the teeth of said magnetic material interlock with the teeth of said intermediate shaft thereby rotationally securing said magnetic material with respect to said intermediate shaft means.

6. A distributor as recited in claim 5 wherein said sensor holder means including an opening for use during assembly of the distributor for receiving a pin of a means for magnetizing said magnetic material thereby rotationally fixing the relationship between the movable magnetic ring-like material and the reference point.

7. A distributor as recited in claim 6 wherein there is sufficient space adjacent said magnetic material to receive a conductor bar for carrying current to magnetize said magnetic material.

* * * * *